United States Patent [19]

Driear

[11] Patent Number: 4,922,571

[45] Date of Patent: May 8, 1990

[54] VACUUM LOADING MACHINE

[75] Inventor: Joseph R. Driear, Thiensville, Wis.

[73] Assignee: Aquatech, Inc., Cleveland, Ohio

[21] Appl. No.: 270,039

[22] Filed: Nov. 14, 1988

[51] Int. Cl.[5] ..... B08B 3/02; B08B 9/04

[52] U.S. Cl. ..... 15/302; 15/315; 15/340.1; 134/168 C

[58] Field of Search ..... 15/302, 315, 340.1; 134/166 C, 167 C, 168 C, 169 C

[56] References Cited

U.S. PATENT DOCUMENTS

| | | | |
|---|---|---|---|
| 3,150,404 | 9/1964 | Johnson | 15/340.1 X |
| 3,348,258 | 10/1967 | Daneman | 15/340.1 X |
| 3,613,915 | 10/1971 | Vita | 15/340.1 X |
| 4,199,837 | 4/1980 | Fisco | 15/302 |
| 4,207,647 | 6/1980 | Masters | 15/302 |
| 4,234,980 | 11/1980 | DiVito et al. | 15/302 |
| 4,446,591 | 5/1984 | Wiedemann | 15/315 |
| 4,525,277 | 6/1985 | Poulin | 15/302 X |
| 4,669,145 | 6/1987 | Kehr | 15/302 |
| 4,805,653 | 2/1989 | Krajicek et al. | 134/166 C |

*Primary Examiner*—Chris K. Moore

*Attorney, Agent, or Firm*—Pearne, Gordon, McCoy & Granger

[57] ABSTRACT

A mobile vacuum loading machine has a swivel assembly permitting the boom to be rotated 360° through the use of internal hydraulic and pneumatic passages in the swivel assembly. The hose reel is mounted on the rear of the machine and capable of being swung out outwardly a full 180° and fixedly held at any position through the use of a linkage assembly attached to a hydraulic cylinder.

22 Claims, 7 Drawing Sheets

VACUUM LOADING MACHINE

BACKGROUND OF THE INVENTION

1. Field of the Invention

This invention relates to mobile machines for loading debris and other material through the use of a vacuum, and more particularly to such machines as adapted for use in sewer cleaning operations.

2. Description of the Prior Art

Mobile vacuum loading machines are well known in the art. Prior mobile vacuum loading machines have been used in various industrial applications, primarily to provide a means for collecting and storing fairly large amounts of debris, and thereafter transporting the debris to a dump. These machines have often been mounted on truck chassis and/or trailers which are towed by a truck. Mobile vacuum loading machines have often been adapted for use in cleaning sewers and catch basins, and use a high-pressure hose which is inserted into lateral sewers for dislodging debris, and have a large diameter suction hose for removing the debris from the catch basin.

The machine is typically provided with a water tank and a water pump. The water pump has an outlet into a hose reel mounted on the machine with hose coiled on the reel. The water hose is often supported by a swing arm to allow the hose reel to be moved horizontally with respect to the rest of the machine. The hose can be unreeled from the reel and inserted into a catch basin or sewer manhole and into the laterals which require cleaning. The hose reel may be mounted on the front of the machine or on the rear of the machine.

The machine also typically has a vacuum tank with a large diameter movable vacuum hose attached to the tank which may be manipulated in the vicinity of the machine by an operator. The vacuum hose is supported by a boom which is mounted on top of the tank. As debris is flushed from the laterals into the catch basin, the vacuum hose draws the debris into the tank.

After the vacuum tank has been filled, it is typical for prior art loading machines to incorporate a hydraulically actuated dump box and tailgate so that the collected material may be dumped at a convenient site.

Examples of such machines are shown in the following U.S. patents.: No. 4,227,893, issued to Shaddock; No. 4,322,868, to Wurster; No. 4,446,591 to Wiedemann; No. 4,525,277, to Poulin; No. 4,578,840, to Pausch; and No. 4,669,145, to Kehr.

When using prior art loading machines, the placement and location of the machine with respect to the work area was often very important. For example, when using such a machine as a sewer cleaning machine, it was often important to have the machine positioned correctly with respect to the manhole or catch basin so that the hose reel and vacuum boom could be operated efficiently. If the machine was not properly positioned, the operator may have been required to move the machine before performing the sewer cleaning operations.

Thus, it is desirable to utilize a machine in which the boom supporting the vacuum hose can be rotated a full 360° to eliminate the requirement for exact placement of the truck relative to the manhole or catch basin to be cleaned. At the same time, it is also desirable to utilize a machine in which the hose reel is capable of as much horizontal movement as possible with respect to the rest of the machine so that it is not necessary to precisely position the hose reel over the manhole and so that any problems of short bends or kinks in the hose are avoided.

Prior art machines have not been capable of providing 360° rotation in the boom. Similarly, some prior art machines have offered only a limited range of travel of the hose reel from its mounting point, or have provided increased range of travel only at the expense of incorporating lost motion or "slop" in the drive mechanism. Thus, the operator was often required to precisely position the machine in order to operate both the boom and the hose reel within the defined limits of operation of the prior art machines.

SUMMARY OF THE INVENTION

The present invention overcomes the disadvantages of the prior art mobile loading machines, and provides other advantages which have been realized heretofore. In accordance with the present invention, a mobile vacuum loading machine is provided in which the boom mounted on top of the tank is capable of full 360° rotation. This full rotation is made possible by designing the swivel assembly used to mount the boom with fluid paths provided internally within the swivel assembly so that fluid actuators on the boom are connected to a fluid control and supply system on the stationary portion of the machine regardless of the position of the boom. Using the design of the present invention, it is possible not only to rotate the boom 360°, but to permit multiple rotations of the boom without requiring the boom to be returned to its original position. This gives the operator increased flexibility in the use of the machine and in the positioning of the machine in use, while permitting the fluid actuators on the boom to maintain a constant fluid connection with the fluid control and supply system on the stationary portion of the machine throughout the entire rotation of the boom.

Furthermore, in accordance with the present invention, the boom is provided with a ball-and-socket joint which permits the boom to be easily lowered or raised. This allows the operator to precisely position the end of the boom over the location to be accessed.

The socket portion of the ball-and-socket joint is made an integral part of the plenum enclosure of the boom assembly. The axis of rotation of the ball-and-socket joint coincides with the axis of the up-and-down rotation of the boom, so that there is a smooth rotation throughout travel of the boom. In accordance with the present invention, stresses involved in supporting or moving the boom do not go through the ball-and-socket joint, but instead are transmitted directly to the base pylon of the boom assembly.

In the machine of the present invention, the boom is pivotally mounted to the base pylon which carries the stresses of holding the boom in position. The base pylon also carries the base end of the cylinders which raise and lower the boom, so that the stresses of lifting the boom are kept entirely in the pylon, and not routed through the vehicle or tank structures.

A further advantage of the present invention resides in the swing mounting of the hose reel on the rear of the tank. Whereas prior art mounting provided a limited amount of horizontal travel of the hose reel as it swung outwardly away from the tank, or used a chain drive in order to achieve 180° movement of the hose reel, the present invention provides movement of the hose reel assembly of substantially more than 90°, and up to and including 180°, without using pulleys, sprockets, chains, or rotary motors. This flexibility further enables the operator to position the machine in a convenient location to operate the machine and avoids the necessity for precisely positioning the machine so that the hose is in the desired position.

The hose reel actuating mechanism of the present invention also locks the hose reel firmly in position at any point in travel, and eliminates the lost motion or "slop" in the drive mechanisms of the prior art. By using a double-actuating hydraulic cylinder, the hydraulic pressure can be locked in both directions when the cylinder is not moving, preventing motion in either direction.

The cylinder which actuates extension of the boom is mounted on the side of the boom rather than the top, so that the boom of the present invention provides a very low profile. The overhead height of the tank, the truck, and the boom is typically less than eight feet, and the entire machine is thus capable of going through a standard eight-foot doorway.

These and other advantages are provided by the vacuum loading machine of the present invention. The vacuum loading machine comprises a body which includes a chassis and a tank on the chassis for holding material. Means are provided for creating a vacuum in the tank. There is a hose through which material is sucked into the tank by the vacuum. A boom assembly supports the hose and provides a conduit through which material from the hose is sucked into the tank. At least one fluid cylinder is on the boom assembly. Fluid supply and control means are provided on the body. A swivel assembly is provided for mounting the boom assembly on top of the body and for rotating the boom assembly 360° with respect to the body. The swivel assembly includes fluid passage means through the swivel assembly to permit fluid to pass to each fluid cylinder on the boom assembly from the fluid supply and control means on the body during the entire 360° rotation of the boom assembly.

In accordance with another aspect of the present invention, a vacuum loading machine comprises a body including a chassis and a tank containing a supply of liquid. A hose is connected to the tank for dispensing the liquid. A hose reel assembly is provided for supporting the hose. The hose reel assembly is mounted on the body. Means are provided for swinging the hose reel assembly outwardly away from the body and inwardly back toward the body. The swinging means comprises an actuator having one end attached to the body. The actuator produces a range of movement and is securely locked in place when not moving. The swinging means also comprises a linkage assembly having one end attached to the other end of the actuator and having the other end attached to the hose reel assembly. The linkage assembly extends the range of movement provided by the actuator.

DETAILED DESCRIPTION OF THE PREFERRED EMBODIMENT

Figure 1:
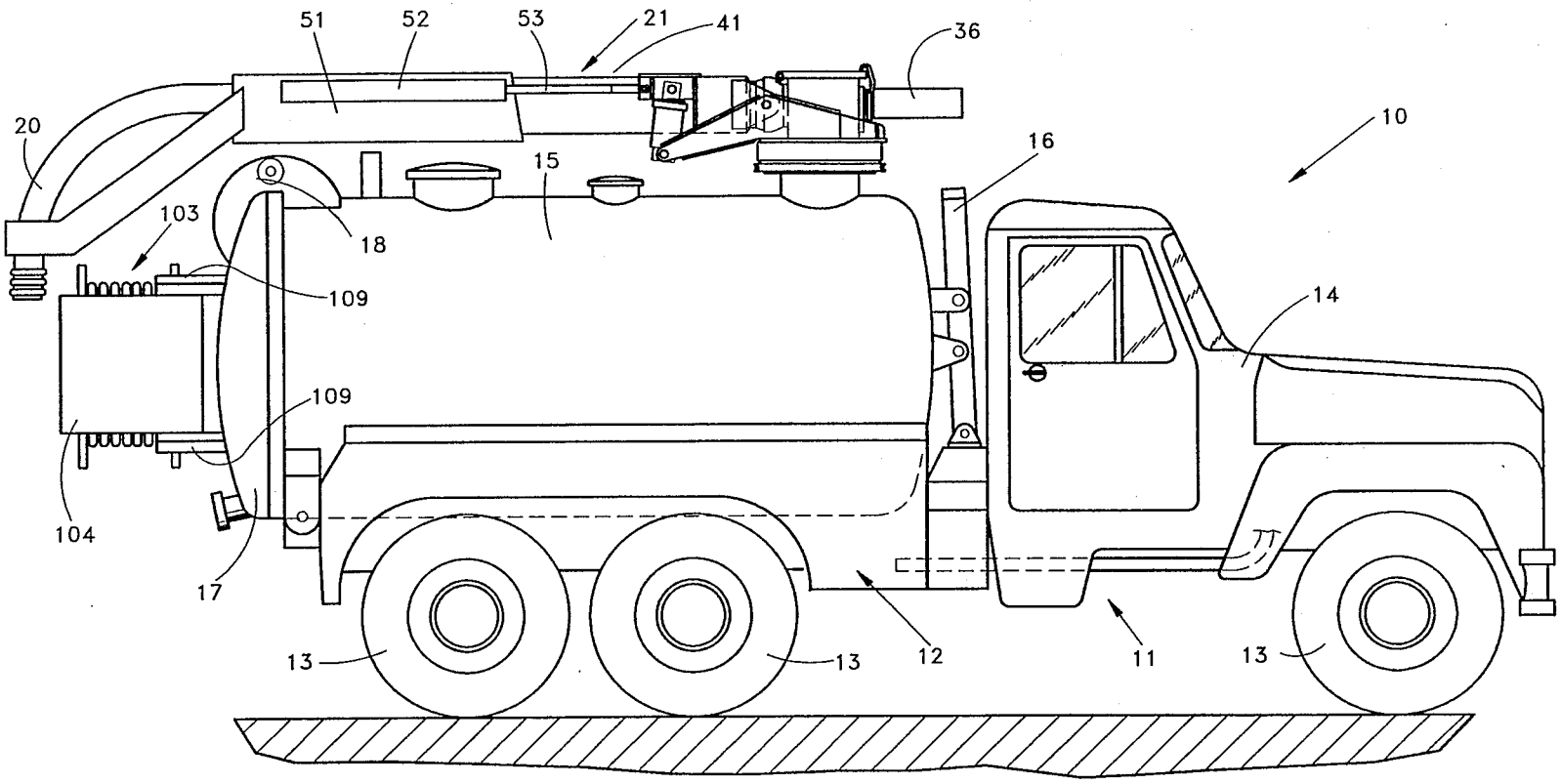
FIG. 1 is a side elevational view of the mobile vacuum loading machine of the present invention.

Referring more particularly to the drawings, and initially to FIG. 1, there is shown the mobile vacuum loading machine 10 of the present invention. The machine comprises a body 11 which includes a truck chassis 12 supported on wheels 13. At the front of the body 11 is a cab 14 supported on the chassis 12. At the rear of the body 11 is a tank assembly 15 which is pivotally mounted on the chassis 12 at the rear of the tank assembly. The tank assembly 15 is capable of being raised by a dumping mechanism 16 about its pivot point on the rear of the chassis 12 so that debris which accumulates in the tank may be dumped out. A door 17 is provided on the rear of the tank assembly 15. The door 17 may be opened when the dumping mechanism 16 raises the tank assembly 15 to permit the debris to be dumped out. The door 17 opens upwardly from the bottom and pivots open about a top-mounted hinge 18. Door locking latches are provided at the bottom of the door 17 to release the door during dumping and to secure the door to the tank assembly 15 with a sufficient sealing force during operation.

While the machine 10 is shown mounted on a truck, it should be noted that the machine could also be mounted on a trailer, or it could be self-propelled, such as on a crawler tractor. Accordingly, the description of the present invention in connection with truck mounting should be taken as illustrative rather than limiting.

The machine includes internal pumping means for producing a vacuum in at least a portion of the tank assembly 15. Such means are well known in the art, and usually include a vacuum pump attached to the tank for pumping air from the tank to reduce the pressure therein. (While the present invention is described in the context of a vacuum loading machine, it should be understood that the invention may also be used in other similar type machines, such as air conveyance loading machines which use a fan or similar device instead of a vacuum pump.) Using the vacuum produced by the vacuum means, debris or other material is sucked into the tank through a hose 20, which is mounted to the top of the tank assembly 15 by a boom assembly 21.

Figure 2:
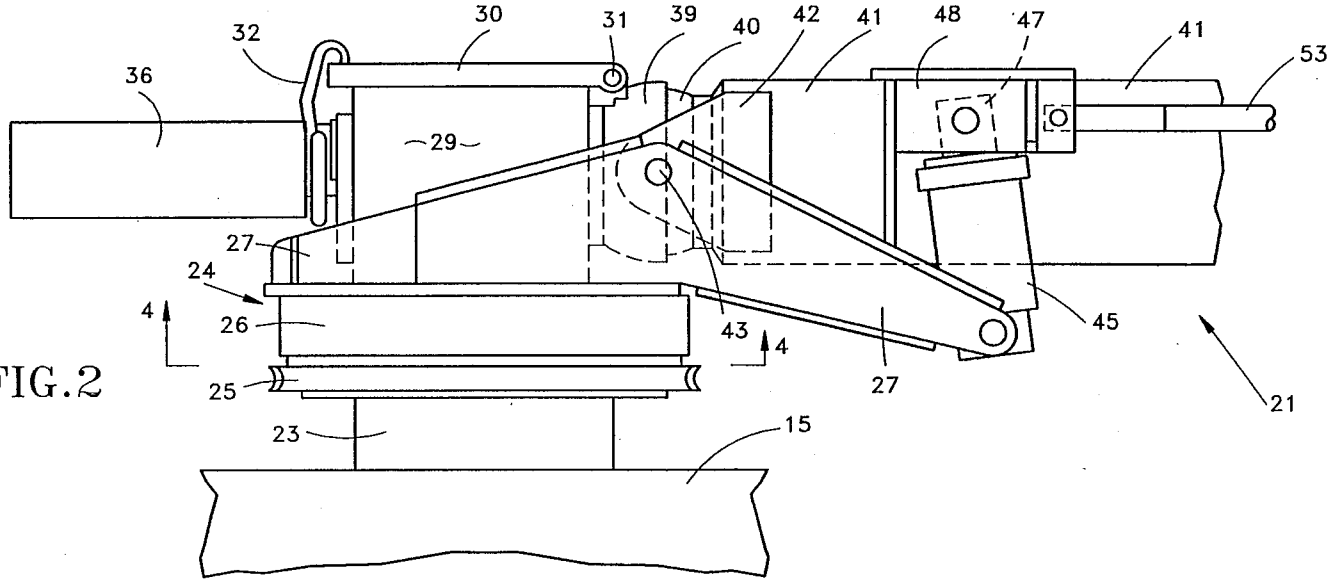
FIG. 2 is an enlarged side elevation of the swivel assembly used in mounting of the boom assembly of FIG. 1.

The mounting of the boom assembly 21 to the tank assembly 15 is shown in greater detail in FIG. 2. A cylindrical flange 23 extends from the top of the tank assembly 15 for permitting debris sucked through the hose to pass into the tank assembly. A swivel assembly 24 is supported on top of the flange 23 and provides a means for rotatably mounting the boom assembly 21 on top of the tank assembly 15. The swivel assembly 24 comprises a rotatable worm wheel or gear 25 which is adapted to engage a drive worm (not shown) which is fixedly mounted to the tank assembly 15. The drive worm engages the worm gear 25 to rotate the boom assembly. An outer swivel ring 26 is mounted on top of the worm gear 25. A base pylon 27 is attached to the top of the outer swivel ring 26.

Within and atop the base pylon 27 is a plenum enclosure 29. On the top of the plenum enclosure 29 is a large hinged cleanout door or lid 30. The lid 30 is attached to the enclosure 29 by a hinge 31. The lid 30 is clamped tightly shut on a gasket of squirted-in-place self-gasketing material by toggle-like clamps 32, which avoids a threaded engagement which may be fouled by dirt and debris. The lid 30 covers an access opening 33 (FIG. 3) in the top of the plenum enclosure 29. The opening 33 is large enough to allow a gloved hand to be inserted inside the plenum enclosure 29. A lifting handle (not shown), also suitably sized for a gloved hand, may be provided for the lid 30.

Figure 3:
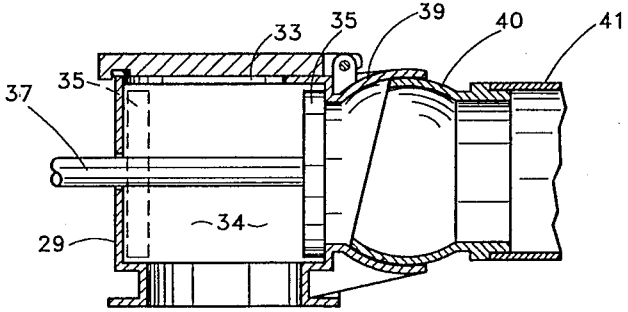
FIG. 3 is a side sectional view of a portion of the swivel assembly of FIG. 2, showing the internal stopper disc and the ball-and-socket joint.

Inside the enclosure 29 is a plenum chamber 34, as shown in FIG. 3. A valve stopped disc 35 sealingly engages one end of the plenum chamber 34 to permit the hose 20 to be sealed from the tank assembly 15. The valve stopper disc 35 is operated by a pneumatic cylinder 36 (FIG. 2) which is externally mounted on one end of the plenum enclosure 29. The pneumatic cylinder 36 is attached to the stopper disc 35 by a rod 37 (FIG. 3). The side opening in the plenum chamber 34 serves as a sealing surface for the stopper disc 35 when it is in its advanced or closed position as shown in FIG. 3.

As shown in FIG. 3, the side of the plenum enclosure 29 also forms a socket portion 39 of a ball-and-socket joint. The ball portion of the ball-and-socket joint is formed by a ball joint member 40 which is attached to the end of a boom tube 41 (FIG. 2). A support member 42 is rigidly attached to the end of the boom tube 41 and is pivotally attached to the base pylon 27 by means of a pin 43 to permit movement of the boom tube upwardly and downwardly with respect to the base pylon. This rotary and vertical movement is accommodated by the ball and socket joint 39 and 40.

Preferably, the ball-and-socket joint 39 and 40 also incorporates a pressure vacuum seal between the ball and socket, a grease pack for lubrication and further sealing, and a lip-type wiper seal to keep outside dirt, sand and debris from the sealing surfaces.

The socket portion 39 of the ball-and-socket joint is made an integral part of the plenum enclosure 29. The axis of rotation of the ball-and-socket joint 39 and 40 coincides with the axis of the up-and-down rotation of the boom assembly 21 as defined by the pivot pin 43, so that there is a smooth rotation throughout travel of the boom. Thus design provides that stresses involved in supporting or moving the boom assembly do not go through the ball-and-socket joint 39 and 40, but instead are transmitted through the support member 42 to the base pylon 27.

Raising and lowering the boom assembly 21 is accomplished by a pair of ram-type hydraulic cylinders, one of which is shown in FIG. 2 as 45 and the other of which 46 is on the opposite side of the boom. The lifting cylinders 45 and 46 raise and lower the boom assembly 21 about the pivot pin 43 between the support member 42 and the base pylon 27. One end of each of the hydraulic cylinders 45 and 46 is connected to the projecting extension of the base pylon 27. A piston rod 47 extends from the other end of each of the hydraulic cylinders 45 and 46, and these piston rods 47 are connected to an anchor member 48. The anchor member 48 extends horizontally above the boom tube 41 and is secured to a boom tube.

The boom assembly 21 is thus pivotally mounted to the base pylon 27 which carries the stresses holding the boom assembly in position. The base pylon 27 also carries the base end of the lifting cylinders 45 and 46 so that the stresses of lifting the boom assembly 21 are kept entirely in the pylon, and not routed through the vehicle or tank structures.

As shown in FIG. 1, the boom assembly 21 is extended and retracted by telescoping movement of the boom tube 41 with respect to another tube 51. Extending and retracting the boom assembly is accomplished by a hydraulic cylinder 52 which is attached at one end to the side of the tube 51. A piston rod 53 extends from the other end of the cylinder 52 and is connected at its far end to the anchor member 48 (FIG. 2). The cylinder 52 is preferably ported through the rod 53, that is, the hydraulic connections for the cylinder extend through the rod. This reduces the column length of the cylinder 52 during extension of the boom assembly 21 and allows the use of a smaller diameter, lighter weight rod. This also permits the use of hydraulic hose connections to the cylinder 52 which are closer to the swivel assembly 24 and will move very little during use.

By mounting the boom extension cylinder 52 on the side of the boom assembly 21 rather than the top, the boom assembly of the present invention provides a very low profile so that the overhead height of the tank assembly 16, the truck chassis 12, and the boom assembly is typically less than eight feet, and the entire machine is thus capable of going through a standard eight-foot doorway.

Figure 6:
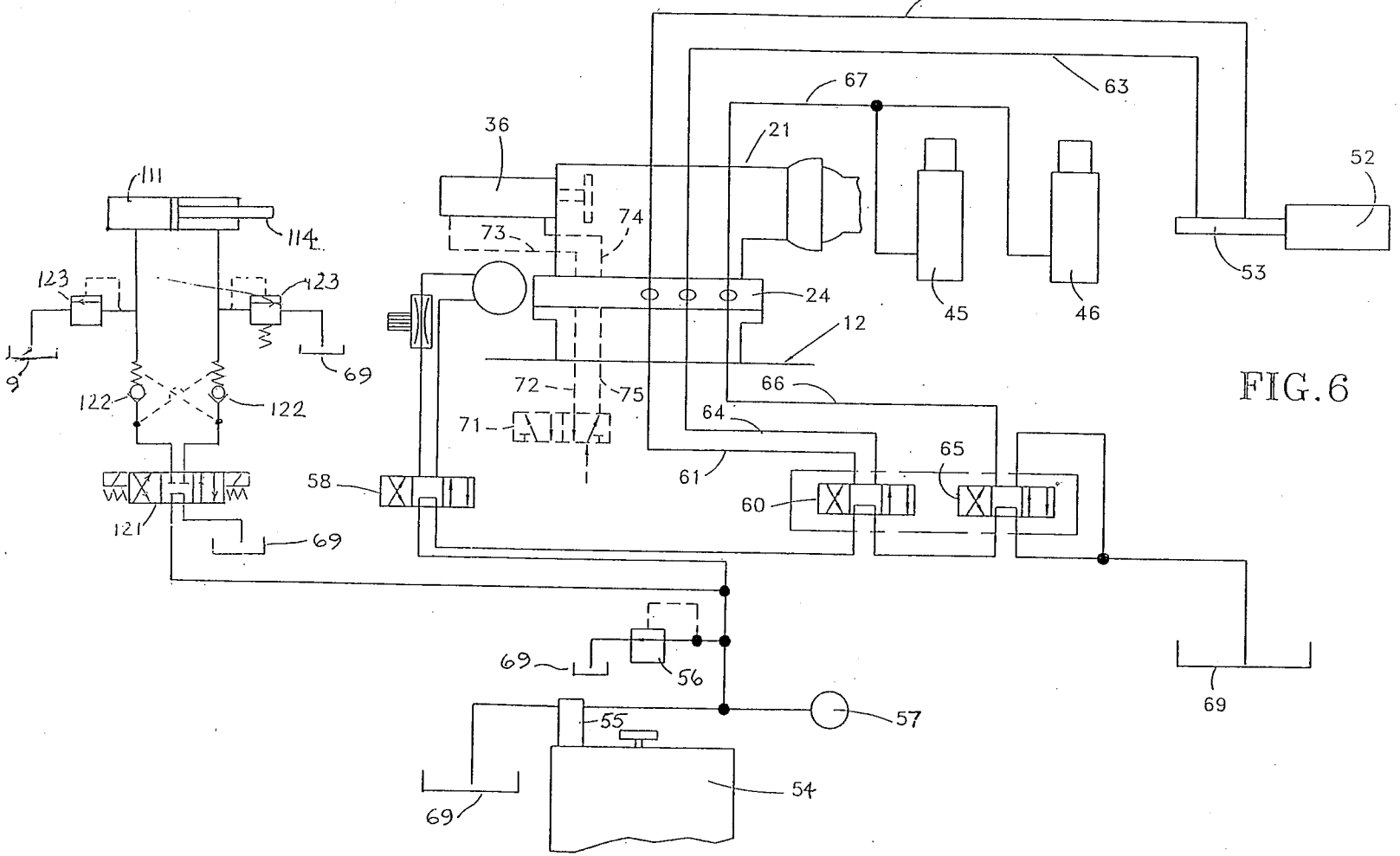
FIG. 6 is a schematic diagram showing the fluid supply and control system and its relationship to the fluid paths through the swivel assembly.

It will be understood that the pneumatic cylinder 36, the boom lifting cylinders 45 and 46, and the boom extension cylinder 52 must be connected to a hydraulic and pneumatic supply. As shown in FIG. 6, the hydraulic and pneumatic supply and control system is located in the stationary body 11, while the cylinders 36, 45, 46 and 52 are located in the revolving boom assembly 21, requiring a connection between the rotating boom assembly and the stationary machine. Specifically, the hydraulic system is powered by an engine 54 located on the truck body 11. The engine 54 powers a hydraulic pump 55 which is used to operate the hydraulic cylinders. The hydraulic paths operate at approximately 1500 psi hydraulic oil pressure. A relief valve 56 is provided to assure that the pressure does not exceed 1500 psi. The hydraulic pressure produced by the pump 55 is measured by a gauge 57. This hydraulic pressure is fed through a valve 58 to a hydraulic motor 59 which operates the worm which drives the worm gear 25 to swivel the boom assembly. The return flow from the hydraulic motor 59 is fed through a valve 60 and through lines 61 and 62 to the to the boom extension cylinder 52. The return flow from the extension cylinder 52 is fed through lines 63 and 64 back through the valve 60 where it is fed through a valve 65 and through lines 66 and 67 to the boom lifting cylinders 45 and 46. When the boom is lowered through the action of gravity, the return flow from the cylinders 45 and 46 flows back through the lines 67 and 66 and through the valve 65 to a reservoir 69.

The pneumatic supply system comprises an air supply (not shown) which produces a supply of compressed air which is fed through a valve 71 and through lines 72, 73, 74 and 75 to the cylinder 36. The pneumatic paths operate at approximately 125 psi air pressure.

Thus, as shown in FIG. 6, five fluid paths 61–62, 63–64, 66–67, 72–73 and 74–75 are needed to connect hydraulic and pneumatic supply and control components on the body or the stationary portions of the machine with the actuating devices located on the swiveling boom assembly.

In accordance with the prior art, these actuating devices on the swiveling boom assembly were connected to the fluid supply and control components on the stationary portions of the machine by hose fittings or other means, which limited the range of movement of the boom assembly. Using prior art designs, booms were capable of, at most, 330° rotation, after which the boom had to be returned to its original position before further rotation could be accomplished in the same direction. In accordance with the present invention, the boom is capable of 360° rotation by a unique fluid passage system which extends internally through the boom swivel assembly 24.

Figure 5:
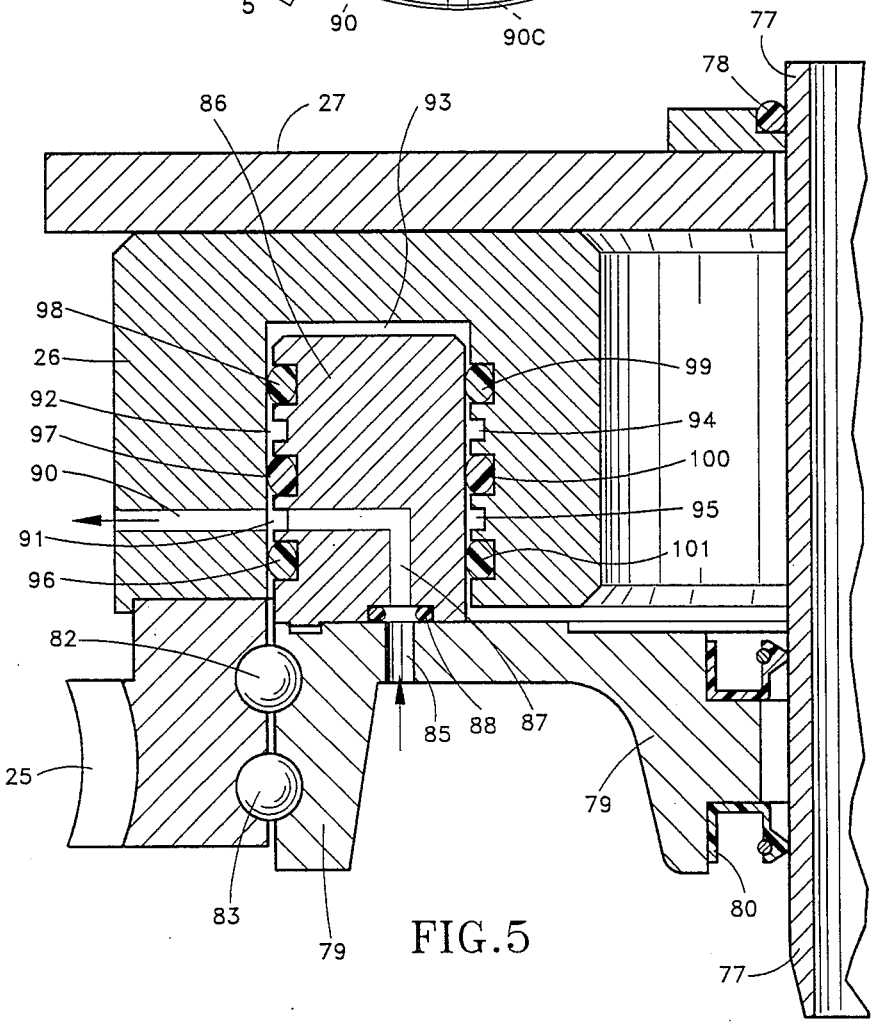
FIG. 5 is a side sectional view taken along line 5—5 of FIG. 4.

The fluid passage system of the present invention can be understood in greater detail with reference to FIG. 5. As shown therein, the boom swivel assembly 24 includes a rotatable cylindrical thimble 77 which is mounted within a double-race slewing bearing fixed on top of the tank flange 23. The thimble 77 is mounted to the pylon 27 and sealed to the bottom of the plenum enclosure 29 by an O-ring seal 78 providing a path for water and debris through the slewing bearing. The slewing bearing provides the swivel assembly 24 with a precision alignment for the mounting of the swivel assembly with alignment shoulders. The double-race slewing bearing comprises an inner bearing race 79 which is fixedly attached to the tank flange 23. A double lip seal 80 provides a seal between the outside diameter of the thimble 77 and the inside diameter of the inner race 79 of the slewing bearing. The slewing bearing, including the inner race 79, is thus stationarily mounted to the tank assembly 15.

The worm gear 25 is mounted for rotation around the inner bearing race 79. Ball bearings 82 and 83 are provided between the worm gear 25 and the inner bearing race 25. The hydraulic motor 59 and the drive worm which engages the worm gear 25 may also be fixedly mounted on the outside of the inner bearing race 25.

The five fluid lines 61, 64, 66, 72 and 75 from the fluid supply and control system for connection to the four cylinders 36, 45, 46 and 52 are connected by fittings to five passages formed in the bottom of the inner bearing race 79. One of these passages 85 is shown in FIG. 5. Supported on top of the bearing race 79 above the passages 85 is an annular inner swivel ring 86. The inner swivel ring 86 has five fluid passages each of which connects with a corresponding passage in the inner bearing race 79. One of these passages 87 is shown in FIG. 5. The bottom of the passage 87 connects with the top of the passage 85 in the race 79, and is sealingly engaged therewith by an O-ring 88.

The stationary inner swivel ring 86 is surrounded on three sides by the rotatable outer swivel ring 26. The outer swivel ring 26 is attached to the worm gear 25 so that it rotates with the boom assembly 21. As shown in FIG. 5, the outer swivel ring 26 is essentially annular with an enlarged circular groove extending upwardly from the bottom, in which the inner swivel ring 86 fits. The base pylon 27 is attached to the top of the outer swivel ring 26.

The outer swivel ring 26 includes five passages through which fluid flows for connection to the cylinders 36, 45, 46 and 52 through the five lines 62, 63, 67, 73 and 74. One of these passages 90 is shown in FIG. 5. The inner swivel ring 86 makes a rotating connection with the outer swivel ring 26 and permits the rotating fluid connection therebetween. Five fluid channels 91, 92, 93, 94, and 95 are formed between the outside of the inner swivel ring 86 and the inside of the outer swivel ring 26. Each of these fluid channels 91–95 is sealingly separated from each other by O-ring type gaskets 96–101. Four fluid channels are provided on the sides of the inner swivel ring 86, fluid channels 91, 92, 94, and 95. An additional fluid channel 93 is provided on the top of the inner swivel ring 86. Each of the passages, such as 87, in the inner swivel ring 86 connect the appropriate passage, such as 85, in the inner bearing race 79 with one of the fluid channels 91–95 between the inner swivel ring and the outer swivel ring 26. Each of the passages, such as 90, in the outer swivel ring 26 connects the appropriate fluid channel 91–95 with an external fitting so that the fluid may be connected to one of lines 62, 63, 67, 73 and 74.

Figure 4:
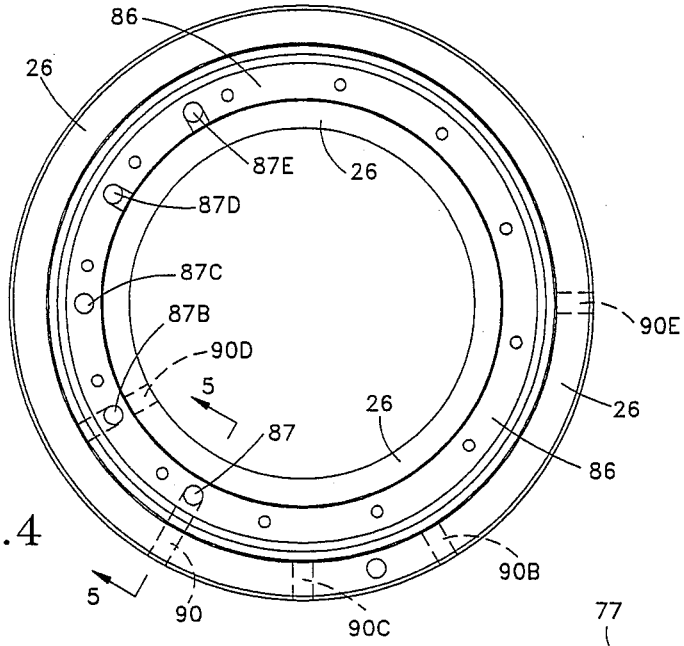
FIG. 4 is a top sectional view taken along line 4—4 of FIG. 2, showing the inner and outer swivel rings of the swivel assembly and the fluid paths therethrough.
Figure 5B:
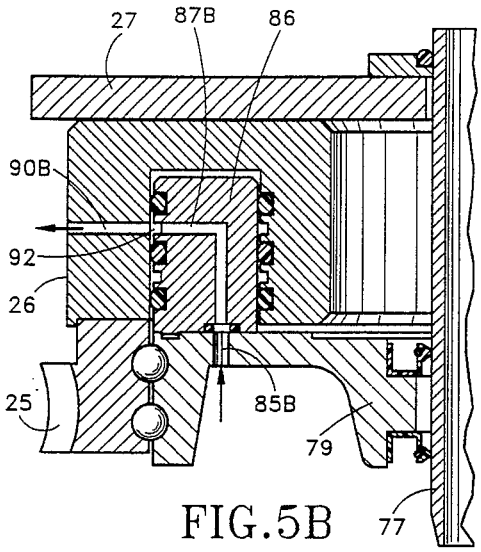
FIGS. 5B–5E are other sectional views similar to FIG. 5, showing the other fluid paths through the swivel assembly.
Figure 5C:
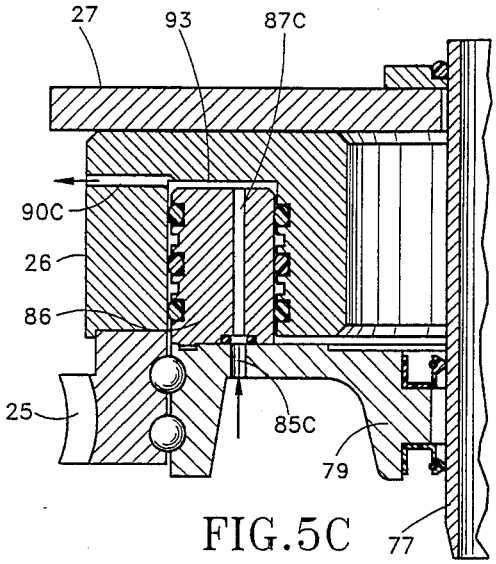
Figure 5D:
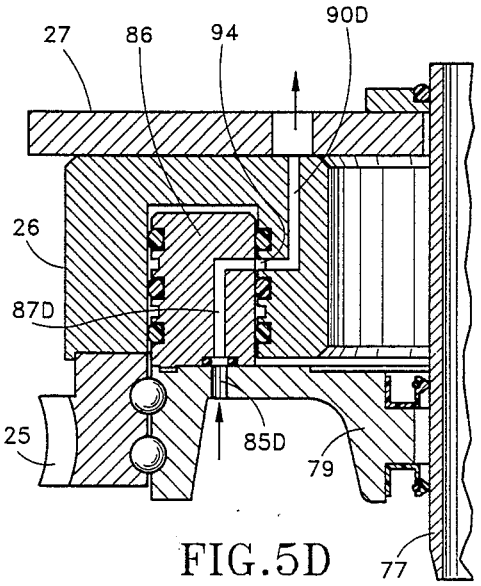
Figure 5E:
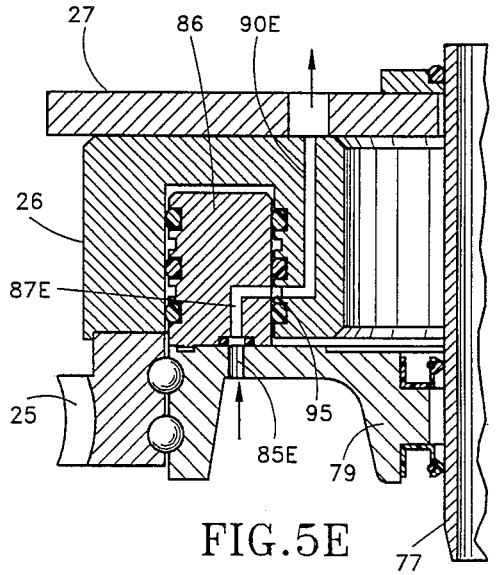

These connections are shown more specifically in FIG. 4 and in FIGS. 5 through 5E. FIG. 5 shows the fluid connection for the hydraulic boom lifting cylinders 45 and 46. The hydraulic line 66 is connected to the passage 85 in the inner bearing race 79. The passage 87 in the inner swivel ring 86 connects the passage 85 with the fluid channel 91. The passage 90 in the outer swivel ring 26 connects the fluid channel 91. The hydraulic line 67 is connected to the passage 90 on the outside of the outer swivel ring 26.

FIG. 5B shows the fluid connection for the retraction of the boom assembly through the hydraulic cylinder 52. The hydraulic line 64 is connected to the passage 85B in the inner bearing race 79. The passage 87B in the inner swivel ring 86 connects the passage 85B with the fluid channel 92. The passage 90B in the outer swivel ring 26 connects the fluid channel 92. The hydraulic line 63 is connected to the passage 90B on the outside of the outer swivel ring 26.

FIG. 5C shows the fluid connection for opening the stopper disc 35 through the pneumatic cylinder 36. The pneumatic line 75 is connected to the passage 85C in the inner bearing race 79. The passage 87C in the inner swivel ring 86 connects the passage 85C with the fluid channel 93. The passage 90C in the outer swivel ring 26 connects the fluid channel 93. The pneumatic line 74 is connected to the passage 90C on the outside of the outer swivel ring 26.

FIG. 5D shows the fluid connection for the extension of the boom assembly through the hydraulic cylinder 52. The hydraulic line 61 is connected to the passage 85D in the inner bearing race 79. The passage 87D in the inner swivel ring 86 connects the passage 85D with the fluid channel 94. The passage 90D in the outer swivel ring 26 connects the fluid channel 94. The hydraulic line 62 is connected to the passage 90D on the top of the outer swivel ring 26.

FIG. 5E shows the fluid connection for closing the stopper disc 35 through the pneumatic cylinder 36. The pneumatic line 72 is connected to the passage 85E in the inner bearing race 79. The passage 87E in the inner swivel ring 86 connects the passage 85E with the fluid channel 95. The passage 90E in the outer swivel ring 26 connects the fluid channel 95. The pneumatic line 73 is connected to the passage 90E on the outside of the outer swivel ring 26.

The use of the proper O-ring type gaskets 96–101 is important to achieve the desired operation of the swivel assembly. These gaskets should have a low coefficient of friction with either the inner swivel ring 86 or the outer swivel ring 26. If, for example, a typical rubber O-ring were used, the friction produced by all of the gaskets 96–101 would be so high as to essentially prohibit the swivel assembly from operating. Suitable O-rings for use as the gaskets 96–101 of the present invention include Teflon encapsulated solid-core silicone O-rings, such as those manufactured by Row, Inc. of Addison, Illinois. Other suitable seals which may be used are O-ring energized glide rings, such as Shamban rotary Glyd Ring assemblies manufactured by W. S. Shamban & Co., of Fort Wayne, Indiana, or elastomeric energized PTFE-type sealing elements, such as Ener-Cap seals manufactured by Green, Tweed and Company, of Kulpsville, Pennsylvania.

The pressure paths are designed so as to provide the lowest pressure exiting at the top flat and bottom inside of the inner swivel ring 86. In the preferred embodiment of the present invention, the lowest pressure exits to the two pneumatic lines 73 and 74 at the passages 90C and 90E. These pressure ports, with exit ports blocked, can be used to disassemble the swivel assembly by using low pressure air pressure.

Ram-type cylinders are used for the boom lifting cylinders 45 and 46 to reduce the number of hydraulic paths required for the lifting cylinders from two to one for each cylinder. By teeing the hydraulic line to each cylinder into a single line 67, a single hydraulic path is needed for both lifting cylinders 45 and 46, and this reduces the number of hydraulic paths needed through the swivel assembly.

Referring again to FIG. 1, the machine 10 includes a hose reel assembly 103, preferably mounted at the rear of the machine. The hose reel assembly 103 includes a reel 104 from which the hose is unwound to supply water to a manhole or underground assembly. A supply of water for the hose is provided in a portion of the tank assembly 15.

Figure 7:
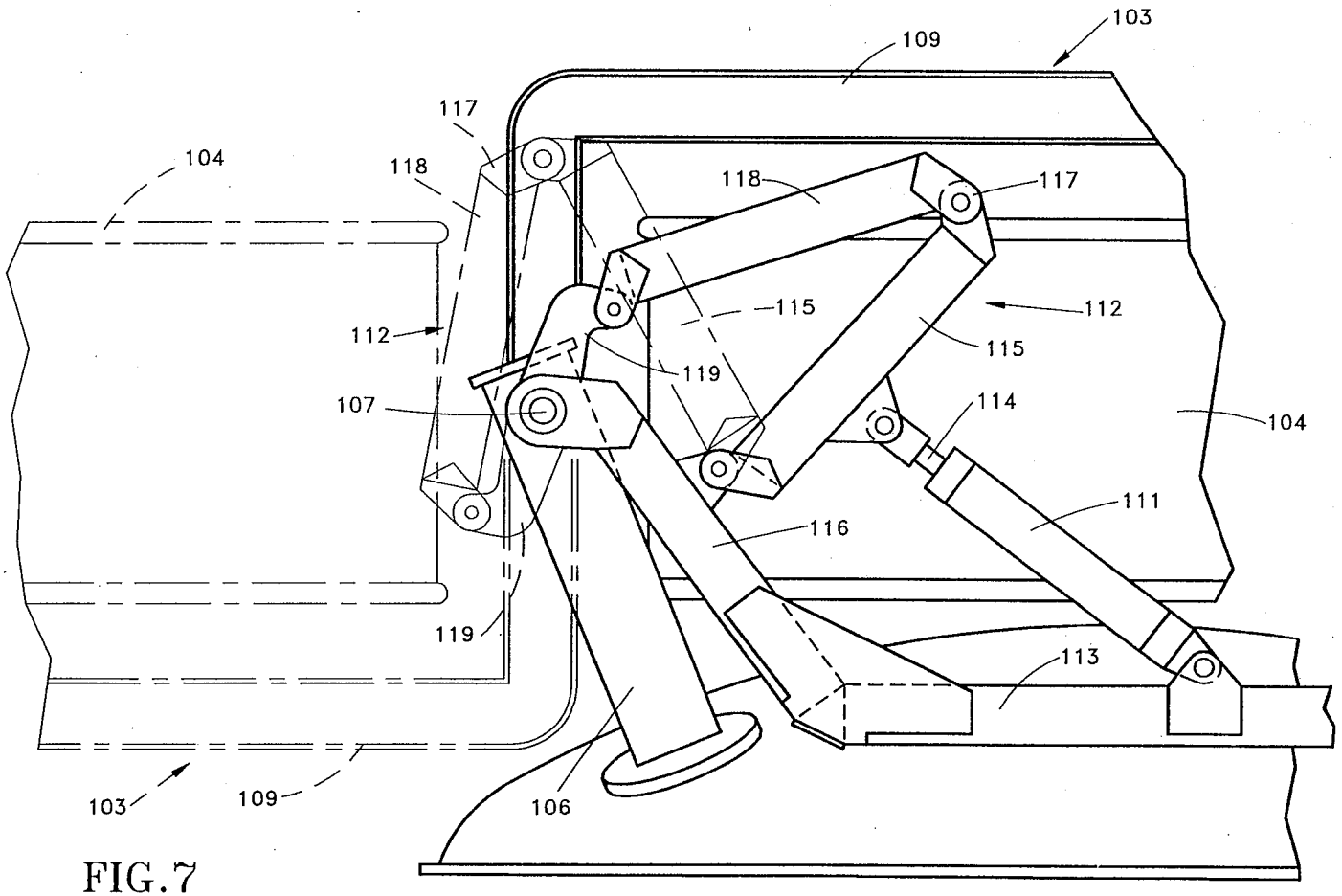
FIG. 7 is a top plan view of the hose reel assembly mounted on the rear of the machine of FIG. 1.
Figure 8:
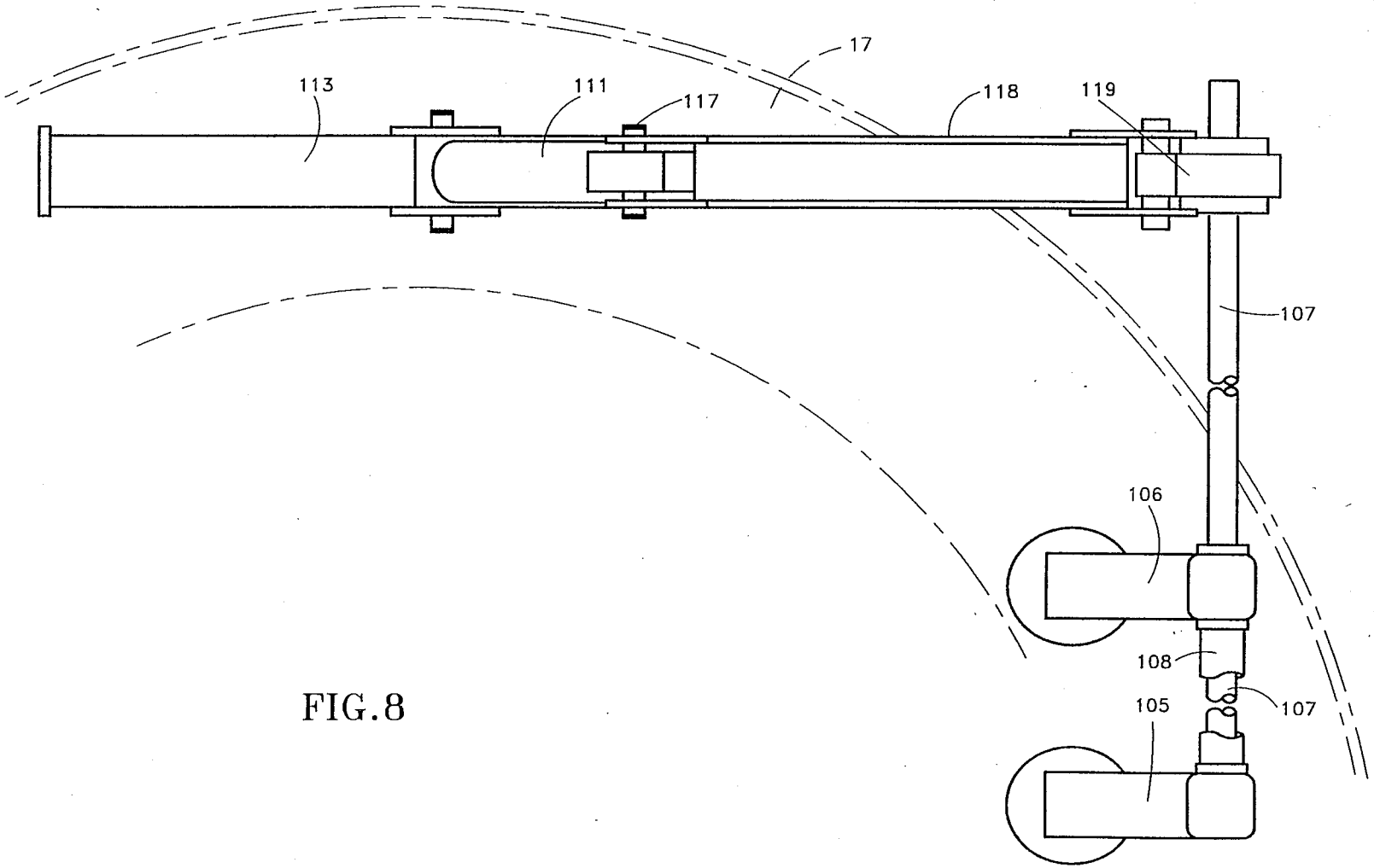
FIG. 8 is an end elevational view of the hose reel assembly of FIG. 7.

Referring to FIGS. 7 and 8, the hose reel assembly 103 is attached to the rear door 17 of the tank assembly 15 by means of two vertically-spaced attachment arms 105 and 106. The attachment arms 105 and 106 provide support for a vertical rod 107 which is mounted to rotate about its longitudinal axis. A swing arm tube 108 envelopes a portion of the support rod 107. The hose reel assembly 103 comprises a pair of swing arms 109 and the hose reel 104 which is supported between the swing arms. The swing arms 109 are welded to the swing arm tube 108 which is demountably pinned to the vertical rod 107 for assembly and disassembly. When the swing arm tube 108 is pinned to the vertical rod 107, the swing arms 109 rotate with the linkage assembly. As the tube 108 rotates, the arms 109 swing the hose reel 108 horizontally outwardly away from the door 17 or inwardly toward the door.

The hose reel assembly 103 thus is pivoted about the axis of the swing arm 108, and consequently is movable between a stored position shown in solid lines in FIG. 7 and a position 180° with respect to the stored condition shown in phantom lines in FIG. 7 of any position therebetween. Movement of the hose reel assembly 103 is accomplished by means of a double-acting hydraulic cylinder 111 acting upon a linkage assembly 112. One end of the hydraulic cylinder 111 is attached to a support 113 which is mounted on the rear door 17 of the tank assembly 15. A piston rod 114 extends from the other end of the cylinder 111 and is connected pivotally to a linkage member 115. One end of the linkage member 115 is pivotally connected to a support extension 116 which extends from the support 113. The end of the support extension 116 is rotatably connected to the top of the vertical rod 107. The remote end of the linkage member 115 is connected by means of a hinge 117 to a second linkage member 118. The end of the linkage member 118 opposite the hinge 117 is pivotally connected to a third linkage member 119 which serves as a crank and is rigidly connected to the vertical rod 107 and rotates therewith.

It can be seen that the provision of the linkage assembly 112 comprising the linkage members 115, 118, and 119 permits the limited amount of travel produced by the hydraulic cylinder 111 to be translated into an increased amount of travel of the hose reel assembly 103. Without the linkage assembly 112, the hydraulic cylinder 111 would be acting directly upon the swing arm 109 of the hose reel assembly, and the possible travel of the swing arm would be considerably less than 180°. With the linkage assembly 112, it is possible to increase the travel of the hose reel assembly 103 to 180°, or even slightly more. This increases the range of movement of the hose reel assembly 103 and allows the hose reel assembly to be more easily used without precisely positioning the entire machine.

The hydraulic cylinder 111 is connected to the hydraulic supply system, as shown in FIG. 6. Pressurized hydraulic fluid is supplied from the pump 55 to a spring-centered, double-acting solenoid valve 121. When the spool in valve 121 is moved to the left as shown in FIG. 6, fluid is supplied to the cylinder 111 behind the piston, and the rod 114 advances to swing the hose reel assembly 103 outwardly. When the spool in valve 121 is moved to the right as shown in FIG. 6, fluid is supplied to the cylinder 111 in front of the piston, and the rod 114 withdraws to retract the hose reel assembly 103. When the hose reel assembly 103 is not being moved, the valve 121 is centered, and fluid is shut off to both ends of the cylinder 111, locking the cylinder in position. Thus, the hose reel assembly 103 is locked in place at all times, except when fluid is applied to the cylinder 111 to move the hose reel assembly.

Check valves 122 are provided in each of the lines between the valve 121 and the cylinder 111 with pilot lines connected to the opposite line to assure that both lines are open when the valve is actuated in either direction, and to assure that both lines are locked closed when the valve spool is centered.

Thermal relief valves 123 are also provided, one relief valve connected to each of the lines from the cylinder 111. The relief valves 123 open to relieve excess pressure which may develop in the cylinder 111 from thermal expansion of the fluid in the cylinder. For example, if the cylinder 111 is locked in position when the fluid is cool, and the cylinder is subsequently exposed to heat, such as from the sun, the fluid pressure in the cylinder might otherwise rise to a level high enough to rupture the cylinder.

Various modifications and variations to the vacuum loading machine shown and described may be made. For example, while the hose reel assembly 103 has been shown mounted on the rear of the tank assembly 15, the hose reel assembly may be instead mounted in front of the cab 14. The linkage assembly 112 would operate in a similar manner at the front of the machine. Likewise, while the machine has been described as a vacuum loading machine, that is, a machine in which a pump is used to create a partial vacuum in the tank, the principles of the present invention may be applied to an air conveyance loading machine, that is, a machine using a fan to create a large volume of conveying air, to achieve the resultant advantages.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A vacuum loading machine which comprises:
- a body including
  - a chassis and
  - a tank on the chassis for holding material;
- means for creating a vacuum in the tank;
- a hose through which material is sucked into the tank by the vacuum;
- a boom assembly supporting the hose and providing a conduit through which material from the hose is sucked into the tank;
- a fluid cylinder on the boom assembly;
- fluid supply means on the body;
- a swivel assembly for mounting the boom assembly on top of the body and for rotating the boom assembly 360° with respect to the body, the swivel assembly including fluid passage means through the swivel assembly to permit fluid to pass to the fluid cylinder on the boom assembly from the fluid supply means on the body during the entire 360° rotation of the boom assembly.

2. A vacuum loading machine as defined in claim 1, wherein the boom assembly is capable of being extended longitudinally, and the fluid cylinder on the boom assembly is actuatable to extend and retract the boom assembly.

3. A vacuum loading machine as defined in claim 1, comprising in addition valve means within the boom assembly for closing the conduit through the boom assembly; and wherein the fluid cylinder on the boom assembly is actuatable to cause the valve means to close the conduit.

4. A vacuum loading machine as defined in claim 1, wherein the boom assembly is pivoted to be capable of vertical movement, and the fluid cylinder on the boom assembly is actuatable to raise and lower the boom assembly.

5. A vacuum loading machine as defined in claim 4, wherein the boom assembly includes a ball-and-socket joint to provide the vertical movement.

6. A vacuum loading machine as defined in claim 1, comprising in addition a ball-and-socket joint on the boom assembly to permit one end of the boom assembly to be raised and lowered without affecting the other end of the boom assembly.

7. A vacuum loading machine as defined in claim 6, wherein the boom assembly includes support means for transmitting the stress of the boom assembly as the end of the boom assembly is raised or lowered from the end of the boom assembly to the swivel assembly without subjecting the ball-and-socket joint to substantial stress.

8. A vacuum loading machine as defined in claim 1, wherein the tank contains a supply of liquid, comprising in addition:
- a hose connected to the tank for dispensing the liquid;
- a hose reel assembly for supporting the hose, the hose reel assembly being mounted on the body;
- means for swinging the hose reel assembly outwardly away from the body and inwardly back toward the body, the swinging means comprising:
  - an actuator having one end attached to the body, the actuator producing a range of movement and being securely locked in place when not moving, and
  - a linkage assembly having one end attached to the other end of the actuator and having the other end attached to the hose reel assembly, the linkage assembly extending the range of movement provided by the actuator.

9. A vacuum loading machine as defined in claim 8, wherein the actuator is a fluid cylinder.

10. A vacuum loading machine as defined in claim 8, wherein the boom assembly is capable of being extended longitudinally, and the fluid cylinder on the boom assembly is actuatable to extend and retract the boom assembly.

11. A vacuum loading machine as defined in claim 8, comprising in addition valve means within the boom assembly for closing the conduit through the boom assembly; and wherein the fluid cylinder on the boom assembly is actuatable to cause the valve means to close the conduit.

12. A vacuum loading machine as defined in claim 8, wherein the boom assembly is pivoted to be capable of vertical movement, and the fluid cylinder on the boom assembly is actuatable to raise and lower the boom assembly.

13. A vacuum loading machine as defined in claim 12, wherein the boom assembly includes a ball-and-socket joint to provide the vertical movement.

14. A vacuum loading machine as defined in claim 8, comprising in addition a ball-and-socket joint on the boom assembly to permit one end of the boom assembly to be raised and lowered without affecting the other end of the boom assembly.

15. A vacuum loading machine as defined in claim 14, wherein the boom assembly includes support means for transmitting the stress of the boom assembly as the end of the boom assembly is raised or lowered from the end of the boom assembly to the swivel assembly without subjecting the ball-and-socket joint to substantial stress.

16. A vacuum loading machine which comprises:
- a body including
- a chassis and
  - a tank on the chassis for holding material;
- means for creating a vacuum in the tank;
- a hose through which material is sucked into the tank by the vacuum;
- a boom assembly supporting the hose and providing a conduit through which material from the hose is sucked into the tank, the boom assembly being capable of being extended longitudinally, the boom assembly pivoted to be capable of vertical movement;

valve means within the boom assembly for closing the conduit through the boom assembly;

a first fluid cylinder on the boom assembly actuatable to extend and retract the boom assembly;

a second fluid cylinder on the boom assembly actuatable to cause the valve means to close the conduit;

a third fluid cylinder on the boom assembly actuatable to raise and lower the boom assembly;

fluid supply on the body;

a swivel assembly for mounting the boom assembly on top of the body and for rotating the boom assembly 360° with respect to the body, the swivel assembly including multiple fluid passage means through the swivel assembly to permit fluid to pass to the first, second and third fluid cylinders on the boom assembly from the fluid supply and control means on the body during the entire 360° rotation of the boom assembly.

17. A vacuum loading machine as defined in claim 16, comprising in addition a ball-and-socket joint on the boom assembly to permit one end of the boom assembly to be raised and lowered without affecting the other end of the boom assembly.

18. A vacuum loading machine as defined in claim 17, wherein the boom assembly includes support means for transmitting the stress of the boom assembly as the end of the boom assembly is raised and lowered from the end of the boom assembly to the swivel assembly without subjecting the ball-and-socket joint to substantial stress.

19. A vacuum loading machine as defined in claim 16, wherein the tank contains a supply of liquid, comprising in addition:

a hose connected to the tank for dispensing the liquid;

a hose reel assembly for supporting the hose, the hose reel assembly being mounted on the body;

means for swinging the hose reel assembly outwardly away from the body and inwardly back toward the body, the swing means comprising:

an actuator having one end attached to the body, the actuator producing a range of movement and being securely locked in place when not moving, and a linkage assembly having one end attached to the other end of the actuator and having the other end attached to the hose reel assembly, the linkage assembly extending the range of movement provided by the actuator.

20. A vacuum loading machine as defined in claim 19, wherein the actuator is a fluid cylinder.

21. A liquid dispensing machine comprising:

a body including a chassis and a tank on the chassis for containing a supply of liquid;

a hose connected to the tank for dispensing the liquid;

a hose reel assembly for supporting the hose, the hose reel assembly being mounted on the body;

means for swinging the hose reel assembly outwardly away from the body and inwardly back toward the body, the swinging means comprising:

an actuator having one end attached to the body, the actuator producing a range of movement and being securely locked in place when not moving, and a linkage assembly having one end attached to the other end of the actuator and having the other end attached to the hose reel assembly, the linkage assembly extending the range of movement provided by the actuator.

22. A liquid dispensing machine as defined in claim 21, wherein the actuator is a fluid cylinder.

* * * * *